US007409065B2

(12) United States Patent
Lo

(10) Patent No.: US 7,409,065 B2
(45) Date of Patent: Aug. 5, 2008

(54) APPARATUS AND METHOD FOR DETECTING SOUND DIRECTION

(75) Inventor: Lih-Shang Lo, Jubei (TW)

(73) Assignee: Sunplus Technology Co., Ltd., Hsinchu (TW)

( * ) Notice: Subject to any disclaimer, the term of this patent is extended or adjusted under 35 U.S.C. 154(b) by 835 days.

(21) Appl. No.: 10/847,400

(22) Filed: May 18, 2004

(65) Prior Publication Data

US 2004/0223623 A1 Nov. 11, 2004

(51) Int. Cl.
*H04R 3/00* (2006.01)
*H04R 29/00* (2006.01)

(52) U.S. Cl. ..... 381/92; 381/56; 381/122

(58) Field of Classification Search ..... 381/56, 381/92, 122, 58

See application file for complete search history.

(56) References Cited

U.S. PATENT DOCUMENTS 4,581,758 A * 4/1986 Coker et al. ..... 381/56
4,898,179 A * 2/1990 Sirota ..... 600/483
2004/0037437 A1 * 2/2004 Symons et al. ..... 381/92

* cited by examiner

*Primary Examiner*—Vivian Chin
*Assistant Examiner*—George C Monikang
(74) *Attorney, Agent, or Firm*—Bacon & Thomas, PLLC

(57) ABSTRACT

An apparatus and method for detecting sound direction is disclosed, which utilizes a plurality of sound source detecting units to receive a plurality of sound signals form a sound source. The sound source detecting units amplify and filter the sound wave signals to obtain a plurality of amplified sound signals, and transform the amplified sound signals to a plurality of pulse signals for being outputted a processing unit. The processing unit samples the pulse signals to obtain a plurality of sampling signal sequences, and computes a plurality of time differences based on the sampling signal sequences to detect the position of the sound source via looking up a table based on the time differences.

10 Claims, 5 Drawing Sheets

APPARATUS AND METHOD FOR DETECTING SOUND DIRECTION

BACKGROUND OF THE INVENTION

1. Field of the Invention

The present invention relates to the technical field of sound direction detection and, more particularly, to an apparatus and method for detecting sound direction.

2. Description of Related Art

FIG. 1 schematically illustrates that human's ears receive sound signals, wherein the sound signals are from a sound source A. The sound signals arrive sequentially at the ears so as to produce a time difference between two sound signals. Accordingly, the human's brain is able to detect the direction of the sound signals based on the time difference. When being implemented by electronic technology, sound signals are received by microphones, and at least two microphones are used to detect sound direction. Typically, the microphones can be classified into non-directional microphones and directional microphones. There is a limitation on using two non-directional microphones to receive sound signals. That is, two non-directional microphones only can detect the sound source at the left and right sides, but can not detect the sound source at the front and rear sides. If detection of the sound source at the front and rear sides is desired, it requires a complex algorithm or directional microphones which are expensive. To avoid using complex algorithm and expensive microphones, three non-directional microphones are used to receive the sound signals form 360 degrees to detect the sound direction of all sides.

There are two well-known sound direction detection techniques. One is known as a peak detection method, which is used for amplifying the sound signals received by the microphones and filtering the amplified sound signals and performing an integral processing so that the sound signals are changed to similar triangle waves. Then, the method finds out each peak of the similar triangle wave corresponding to a microphone and compares the peaks of the similar triangle waves to obtain time differences, thereby detecting the sound direction based on an equation $\Delta T=(a\theta+a \sin \theta)/c$, wherein c is velocity of sound and $\Delta T$ is time difference and the transformation diagram between the time difference and the incident angle as shown in FIG. 2.

The other sound direction detection technique is known as a cross-correlation method, which is used for amplifying the sound wave signals received by the microphones and filtering the amplified sound wave signals, thereby converting the sound wave signals to digital data via a analog/digital converter (ADC). Then, the method performs a cross-correlation operation for the digital data corresponding to different microphones to obtain a maximum cross-correlation value (time difference), so as to find out an incident angle of the sound wave signals to detect the sound direction.

However, the above two methods both need to use ADCs, and thus the cost is high. Furthermore, the usual microphones are condenser microphones, and the equivalent capacitances of the condenser microphones are different, which results in producing time shift to negatively affect sound direction detection. In addition, the above cross-correlation method has to perform statistic operation on the lengthy digital data, which results in heavy computation and requires complicated multiplication.

SUMMARY OF THE INVENTION

The object of the present invention is to provide an apparatus and method for detecting sound direction without using ADC and complicated computation, and without being affected by condenser microphones.

In accordance with one aspect of this invention, there is provided an apparatus for detecting sound direction, which comprises: a plurality of sound source detecting units, each receiving a sound signal from a sound source, amplifying and filtering the sound signal for generating a amplified sound signal, and then transforming the amplified sound signal to a pulses signal; and a processing unit, coupled to the sound source detecting units, respectively, for sampling the pulse signals outputted from the sound source detecting units to generate a plurality of sampling signal sequences, and then performing a maximum likelihood method on the sampling signal sequences to obtain a plurality time differences, thereby detecting a position of the sound source via a table look-up method based on the time differences.

In accordance with another aspect of this invention, there is provided a method for detecting sound direction, which comprises: a detection parameter setting step for setting at least one sampling length parameter and one detecting number parameter; a sound wave signal transforming step for receiving a plurality of sound signals from a sound source and transforming the sound signals to a plurality of pulse signals; a sampling step for sampling the pulse signals based on the sampling length parameter, and computing a plurality of time differences via a maximum likelihood method; and a table look-up step for comparing the time differences and a incident angle table to obtain a plurality of sound signal incident angles, thereby detecting the position of the sound source of the sound wave signals based on the sound wave signal incident angles.

Other objects, advantages, and novel features of the invention will become more apparent from the following detailed description when taken in conjunction with the accompanying drawings.

DETAILED DESCRIPTION OF THE PREFERRED EMBODIMENT

Figure 3:
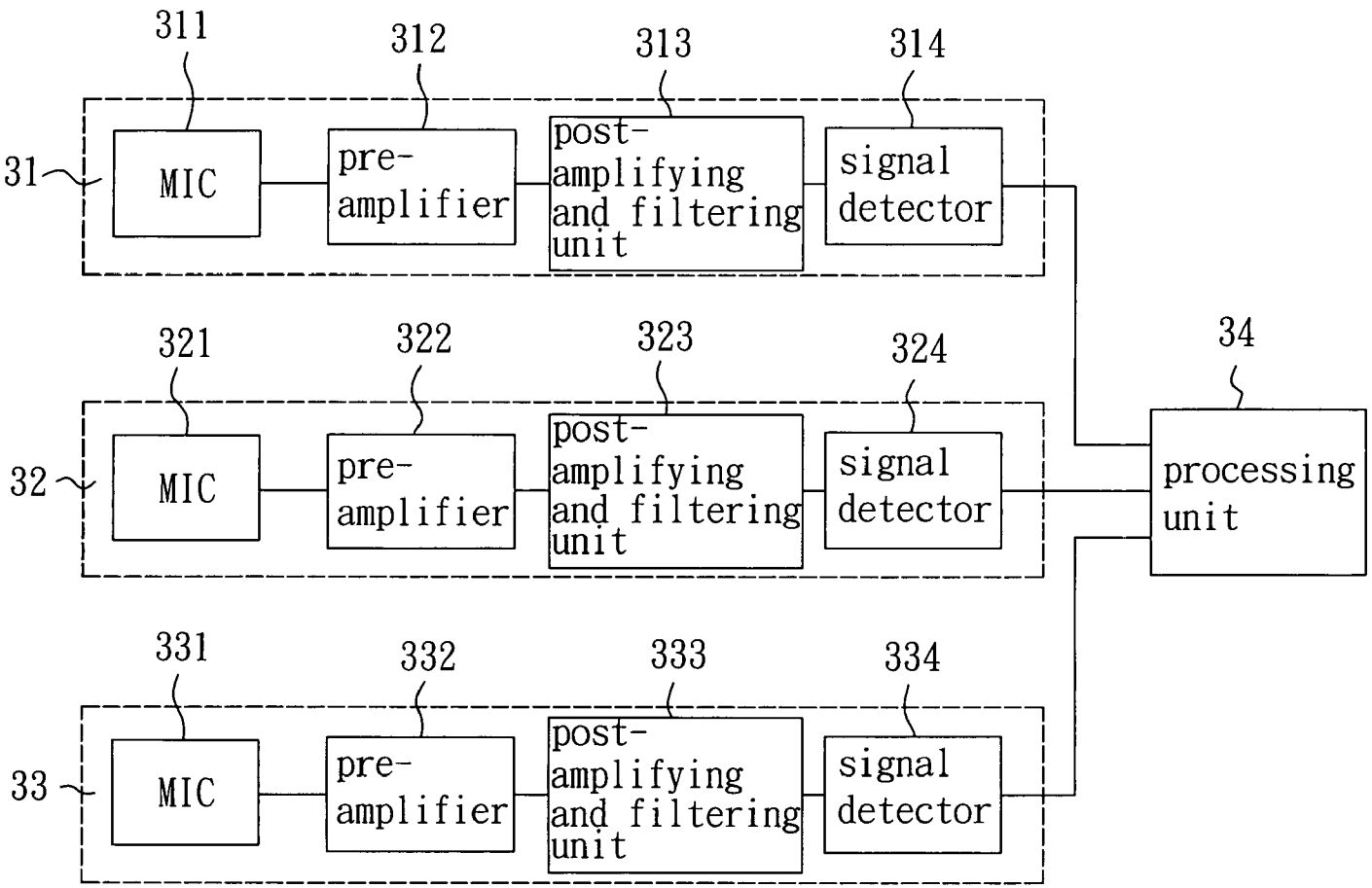
FIG. 3 is a block diagram of the apparatus for detecting sound direction in accordance with a preferred embodiment of the present invention.

With reference to FIG. 3, there is shown an apparatus for detecting sound direction in accordance with an embodiment of the present invention, which includes three sound source detecting units 31, 32, 33 and a processing unit 34. The sound source detecting units 31, 32, 33 have microphones (MICs) 311, 321, 331, pre-amplifiers 312, 322, 332, post-amplifying and filtering units 313, 323, 333 and signal detectors 314, 324, 334, respectively.

Each output of the sound source detecting units 31, 32, 33 is connected to the input of the processing unit 34, so that MICs 311,321,331 receive a plurality of sound signals form a sound source and the received sound signals are transformed to a plurality of pulse signals for being output to the processing unit 34 to perform a sound direction detecting operation.

The outputs of MICs 311, 321, 331 are connected to the inputs of the pre-amplifiers 312, 322, 332, and the outputs of the pre-amplifiers 312, 322, 332 are connected to the inputs of the post-amplifying and filtering units 313, 323, 333. The outputs of the post-amplifying and filtering units 313, 323, 333 are connected to the signal detectors 314,324,334.

In this embodiment, the pre-amplifiers 312, 322, 332 respectively employ bipolar junction transistors (BJTs) such as NPN-BJT to amplify signal so as to avoid the time shifting effect, and perform pre-amplifying on the sound signals received by MICs 311, 321, 331 to express the feature of the sound wave signals. In this embodiment, the signal detectors 314, 324, 334 are preferably zero crossing detectors (ZCDs) for processing the sound signals to generate pulse signals having high transition and low transition (i.e., zero crossing signal).

Figure 4:
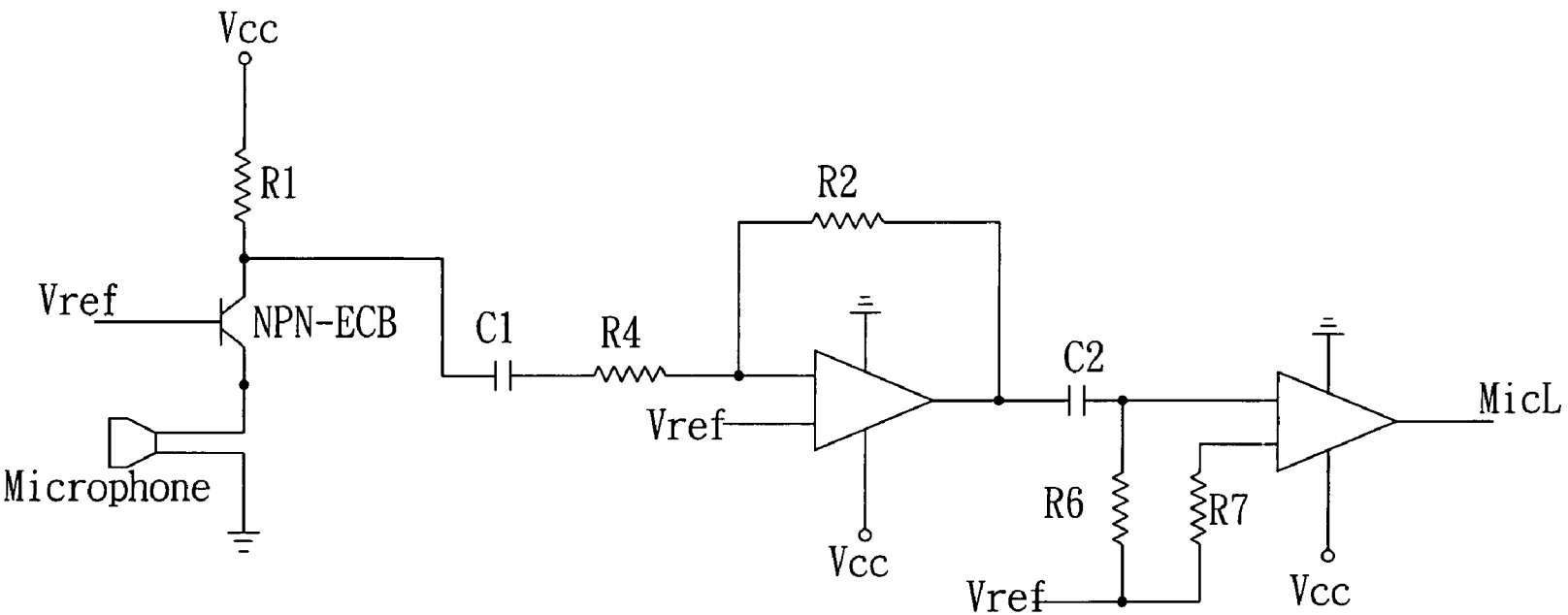
FIG. 4 is a circuit diagram of the sound source detecting unit of the present invention.
Figure 5:
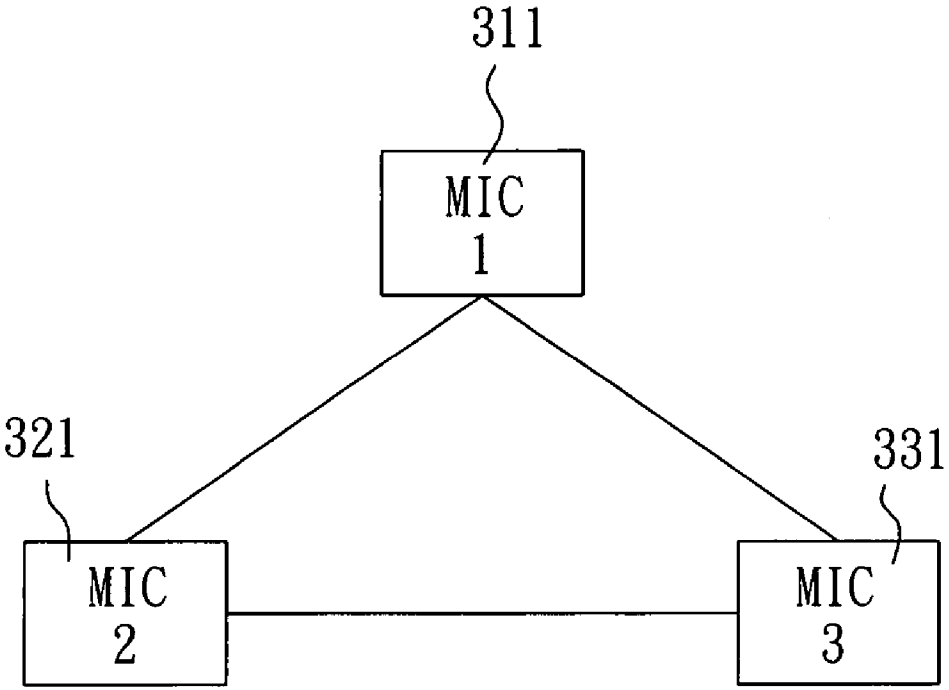
FIG. 5 shows the allocation of the microphones of the present invention.

The sound source detecting units 31, 32, 33 can be implemented by typical electrical components. For example, FIG. 4 shows an exemplary circuit diagram of the sound source detecting units 31, 32, 33, and FIG. 5 shows the allocation of MICs 311, 321, 331, wherein MICs 311, 321, 331 are positioned at the apex of a regular triangle, respectively. The processing unit 34 performs sound direction detecting operation as described hereinafter.

Figure 6:
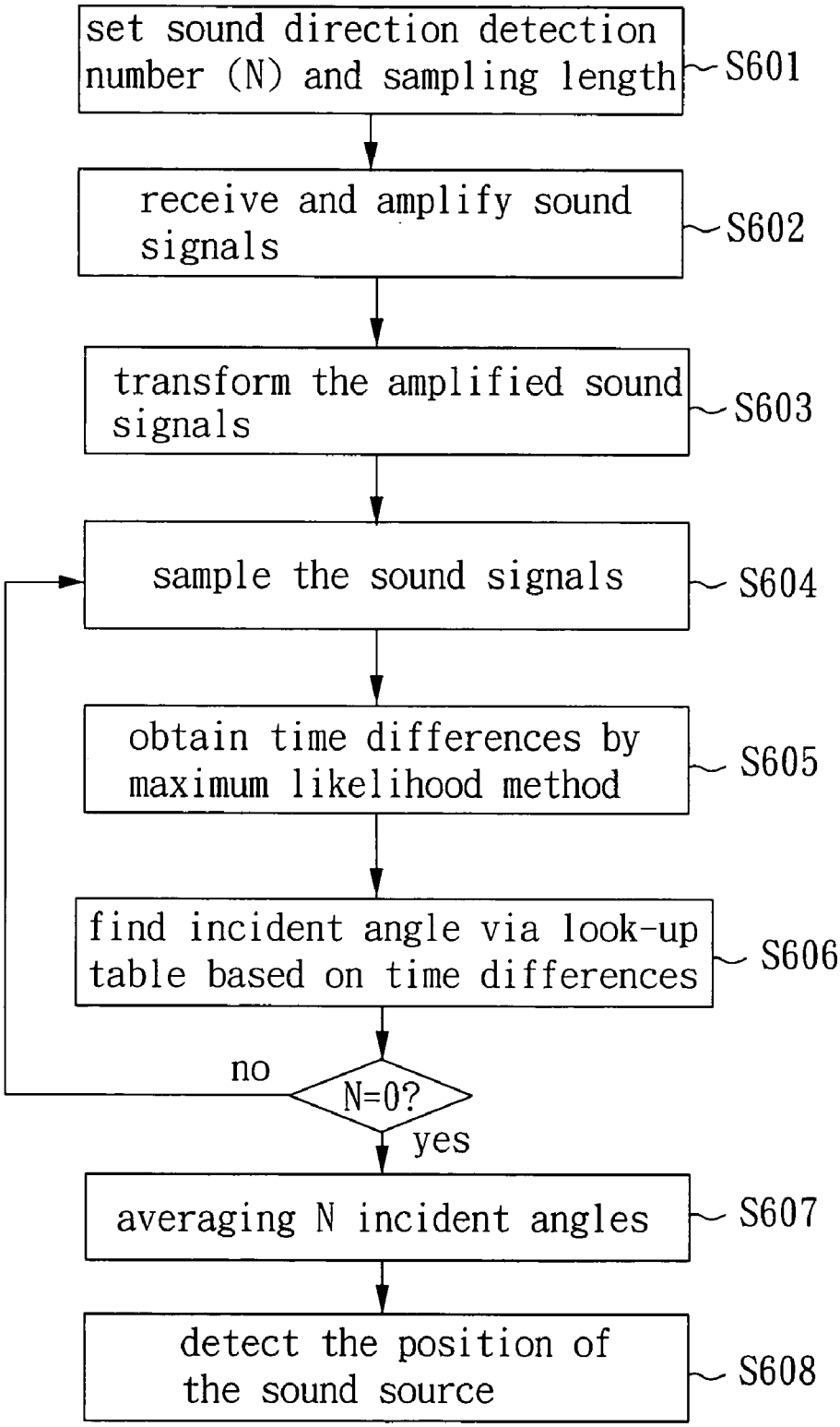
FIG. 6 is a flowchart of the method for detecting sound direction in accordance with a preferred embodiment of the present invention.

FIG. 6 shows a flowchart of the sound direction detecting method of this embodiment. In step S601, an initialization is set for the number of performing sound direction detection (N) and the sampling length (L). In step S602, MICs 311, 321, 331 receive a plurality of sound signals from a sound source, and the pre-amplifiers 312, 322, 332 amplify the sound signals to express the feature of the sound signals. The post-amplifying and filtering units 313, 323, 333 post-amplify and filter the pre-amplified sound signals, so that the sound signals can be detected by the signal detectors 314, 324, 334. Alternatively, the above filtering operation may be performed by an external component.

In step S603, the signal detectors 314, 324, 334 detect the sound signals to generate the pulse signals having high transitions and low transitions, and then issue the pulse signals to the processing unit 34. In step S604, the processing unit 34 samples the pulse signals to generate a plurality of sampling signal sequences based on a predetermined sampling frequency (fs), wherein the predetermined sampling frequency is set based on the spacing of MICs 311, 321, 331 shown in the FIG. 5, the sampling signal sequences are represented as $\chi_1$, $\chi_2$, $\chi_3 \in \{1,0\}$, and the length of each sampling signal sequence is L.

In step S605, the processing unit 34 computes the sampling signal sequences to obtain a plurality of time differences based on a maximum likelihood method after the processing unit 34 generates the sampling signal sequences. Namely, each time difference is computed from two different sampling signal sequences, wherein the time differences are represented as $\Delta_1$, $\Delta_2$ and $\Delta_3$, $\Delta_1$ being the time difference between $\chi_1$ and $\chi_2$, $\Delta_2$ be time difference between $\chi_2$ and $\chi_3$, $\Delta_3$ being the time difference between $\chi_3$ and $\chi_1$. The maximum likelihood method is performed as follows:

$L(a|x)=f(x|a)$ for a in A and x in S, if $a=\Delta_1$, then $x=\chi_1(n)\cdot\chi_2(n+\Delta_i)$, if $a=\Delta_2$, then $x=\chi_2(n)\cdot\chi_3(n+\Delta_2)$, if $a=\Delta_3$, then $x=\chi_3(n)\cdot\chi_1(n+\Delta_3)$, wherein A is a possible time difference ($A\in\{0,\Delta_{possible\ max}\}$) and $S\in\{1,0\}$. Thus, the maximum likelihood method is to compute the time differences and maximize the corresponding $L(a|x)=f(x|a)$. Since the signal processed by the processing unit 34 is $\in\{1,0\}$, the multiplication which the processing unit 34 performs can be substituted by the logical AND operation to reduce the computing load.

Figure 1:
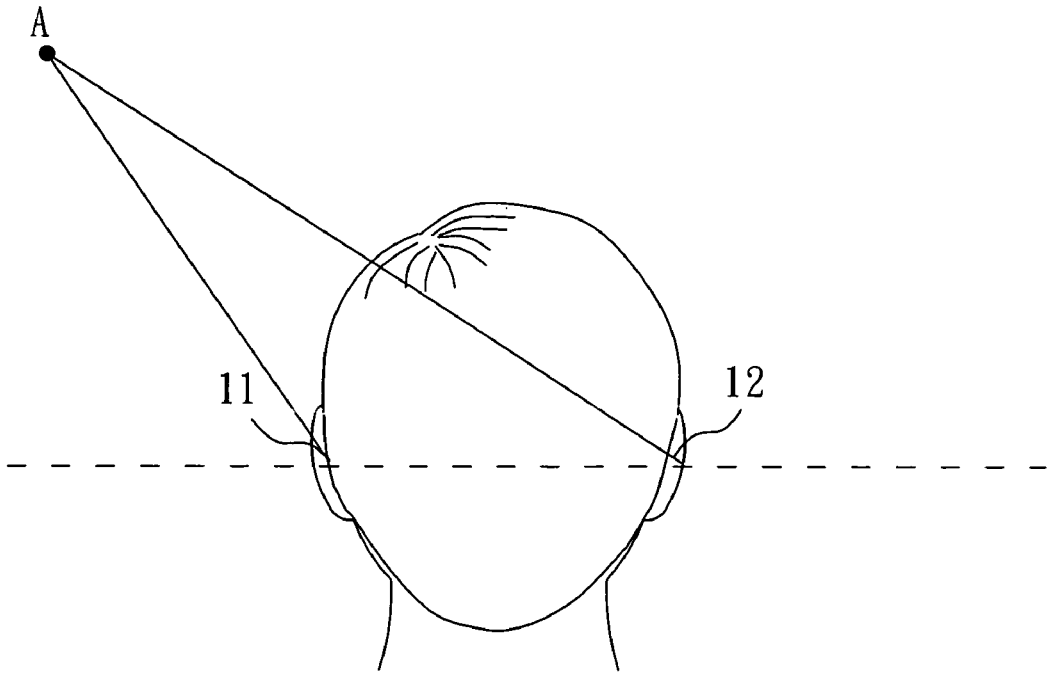
FIG. 1 (PRIOR ART)
FIG. 1 schematically illustrates that human's ears receive sound signals.
Figure 2:
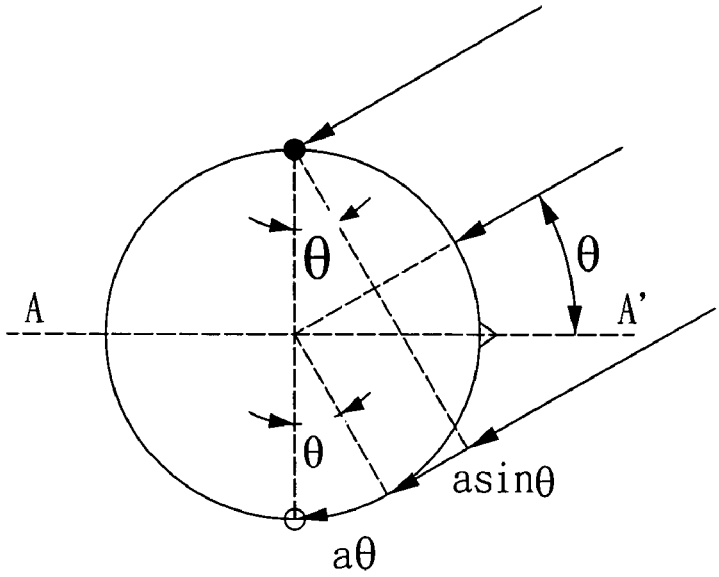
FIG. 2 (PRIOR ART)
FIG. 2 is a transformation diagram according to an incident angle and time differences.

In step S606, the processing unit 34 compares the time differences with an incident angle look-up table, which has a plurality of time difference values and a plurality of corresponding incident angles. The incident angle look-up table is constructed based on the allocation of MICs 311, 321, 331, the transformation diagram between the time difference and the incident angle shown in FIG. 2, and the expression of $\Delta T=(a\theta+a\sin\theta)/c$. Alternatively, the processing unit 34 may compute the incident angle via a mathematic operation. However, this will affect the performance of the processing unit 34.

There may be error generated in the process from MICs 311,321,331 receiving the sound signals to the complete of sampling. For reducing error probability, the processing unit 34 stores the obtained incident angle into a register or a buffer, and then performs step S604, S605 and S606 repeatedly based on the predetermined number of performing sound direction detection to obtain a plurality of incident angles. In step S607, the processing unit 304 eliminates the maximum and the minimum of the incident angles, and then perform statistic operations, such as sorting and averaging, on the incident angles to obtain an approximate incident angle. In step S608, the processing unit 304 detects the position of the sound source.

In view of the foregoing, it is known that the present invention utilizes the pre-amplifier having at least one bipolar junction transistor to pre-amplify the sound signals received by MICs form a sound source, and utilizes ZCDs to transform the sound signals to a pulse signal having high transition and low transition so that the processing unit samples the pulse signal to obtain a plurality of time differences. The processing unit computes an incident angle, and then detects the position of the sound source based on a predetermined incident angle table to achieve the detection of sound source without using ADC and complicated computation, and without being affected by condenser microphones.

Although the present invention has been explained in relation to its preferred embodiment, it is to be understood that many other possible modifications and variations can be made without departing from the spirit and scope of the invention as hereinafter claimed.

What is claimed is:

1. An apparatus for detecting sound direction, comprising:

a plurality of sound source detecting units, each receiving a sound signal from a sound source, amplifying and filtering the sound signal for generating a amplified sound signal, and then transforming the amplified sound signal to a pulses signal; and a processing unit, coupled to the sound source detecting units, respectively, for sampling the pulse signals outputted from the sound source detecting units to generate a plurality of sampling signal sequences, and then performing a maximum likelihood method on the sampling signal sequences to obtain a plurality time differences, thereby detecting a position of the sound source via a table look-up method based on the time differences;

wherein the sampling signal sequences are represented as $\vec{\chi}_1$, $\vec{\chi}_2$, $\vec{\chi}_3 \in\{1,0\}$, the sampling length of the sampling signal sequence sampled by the processing unit is L, and the time differences are represented as $\Delta_1$, $\Delta_2$, $\Delta_3$, where $\Delta_1$ is the time difference between $\vec{\chi}_1$ and $\vec{\chi}_2$, $\Delta_2$ is the time difference between $\vec{\chi}_2$ and $\vec{\chi}_3$, $\Delta_3$ is the time difference between $\vec{\chi}_3$ and $\vec{\chi}_1$; and the maximum likelihood method is performed as follows:

$L(a|x)=f(x|a)$ for a in A and x in S, if $a=\Delta_1$, then $x=\vec{\chi}_1(n)\cdot\vec{\chi}_2(n+\Delta_1)$, if $a=\Delta_2$, then $x=\vec{\chi}_2(n)\cdot\vec{\chi}_3(n+\Delta_2)$, if $a=\Delta_3$, then $x=\vec{\chi}_3(n)\cdot\vec{\chi}_1(n+\Delta_3)$, where A is a possible time difference ($A\in\{0,\Delta_{possible\ max}\}$) and $S\in\{1,0\}$, thereby computing the time differences and maximizing the corresponding $L(a|x)=f(x|a)$.

2. The apparatus as claimed in claim 1, wherein each sound source detecting unit further comprises a pre-amplifier and a signal detector for transforming the sound signals to the pulse sequences having high transition and low transition.

3. The apparatus as claimed in claim 2, wherein each sound source detecting unit further comprises a receiver coupled to the pre-amplifier and a post-amplifying and filtering unit coupled to the pre-amplifier, the signal detector being coupled to the post-amplifying and filtering unit and the processing unit, respectively.

4. The apparatus as claimed in claim 2, wherein each pre-amplifier employs a bipolar junction transistor (BJT) for amplification.

5. The apparatus as claimed in claim 4, wherein the BJT is a NPN transistor.

6. The apparatus as claimed in claim 2, wherein each signal detector is a zero crossing detector (ZCD).

7. The apparatus as claimed in claim 2, wherein the processing unit performs the table look-up method based on an incident angle table having a plurality of predetermined time difference values and a plurality of incident angle, thereby comparing the time differences and the predetermined time difference values to obtain a corresponding incident angle for detecting the source position of the sound signals.

8. A method for detecting sound direction, comprising:

a detection parameter setting step for setting at least one sampling length parameter and one detecting number parameter;

a sound wave signal transforming step for receiving a plurality of sound signals from a sound source and transforming the sound signals to a plurality of pulse signals;

a sampling step for sampling the pulse signals based on the sampling length parameter, and computing a plurality of time differences via a maximum likelihood method; and a table look-up step for comparing the time differences and a incident angle table to obtain a plurality of sound signal incident angles, thereby detecting the position of the sound source of the sound wave signals based on the sound wave signal incident angles;

wherein the maximum likelihood method includes the following steps:

$L(a|x)=f(x|a)$ for a in A and x in S, if $a=\Delta_1$,then $x=\vec{\chi}_1(n)\cdot\vec{\chi}_2(n+\Delta_1)$, if $a=\Delta_2$,then $x=\vec{\chi}_2(n)\cdot\vec{\chi}_3(n+\Delta_2)$, if $a=\Delta_3$,then $x=\vec{\chi}_3(n)\cdot\vec{\chi}_1(n+\Delta_3)$, where A is a possible time difference ($A\in\{0,\Delta_{possible\ max}\}$) and $S\in\{1,0\}$, thereby computing the time differences and maximizing the corresponding $L(a|x)=f(x|a)$, $\vec{\chi}_1$, $\vec{\chi}_2$, $\vec{\chi}_3\in\{1,0\}$are sampling signal sequence of the pulse signals, L is the sampling length of the sampling signal sequence sampled by the processing unit, and $\Delta_1$, $\Delta_2$, and $\Delta_3$ are the time differences, where $\Delta_1$ is the time difference between $\vec{\chi}_1$ and $\vec{\chi}_2$, $\Delta_2$ is the time difference between $\vec{\chi}_2$ and $\vec{\chi}_3$, and $\Delta_3$ is the time difference between $\vec{\chi}_3$ and $\vec{\chi}_1$.

9. The method as claimed in claim 8, further comprising an averaging step after the table look-up step, for temporarily storing the sound signal incident angles and performing plural times of the sampling step and the table look-up step based on the detecting parameter for obtaining plural sets of sound signal incident angles to be averaged.

10. The method as claimed in claim 9, wherein the averaging step excludes the maximum and the minimum of the sound wave signal incident angles.

* * * * *